US005728005A

United States Patent [19]

Rothbard

[11] Patent Number: 5,728,005

[45] Date of Patent: Mar. 17, 1998

[54] SLIDE WITH LATERAL SIDE CHANNELS

[76] Inventor: Robert K. Rothbard, P.O. Box 593, Galveston, Tex. 77553

[21] Appl. No.: 622,997

[22] Filed: Mar. 28, 1996

[51] Int. Cl.[6] ..... A63G 21/04

[52] U.S. Cl. ..... 472/116; 472/117

[58] Field of Search ..... 472/116, 117, 472/88; 52/184, 185, 186, 187; 104/69, 70; 182/48; 256/66, 59; 482/35, 36, 37

[56] References Cited

U.S. PATENT DOCUMENTS

| | | | |
|---|---|---|---|
| 1,680,753 | 8/1928 | Thornton | 472/116 |
| 2,841,396 | 7/1958 | Foss | 472/116 |
| 4,391,201 | 7/1983 | Bailey | 472/88 |
| 4,865,311 | 9/1989 | Beekenkamp | 472/116 |

FOREIGN PATENT DOCUMENTS

| | | | |
|---|---|---|---|
| 1558661 | 1/1980 | United Kingdom | 472/116 |

*Primary Examiner*—Kien T. Nguyen
*Attorney, Agent, or Firm*—Kenneth A. Roddy

[57] ABSTRACT

A slide or chute having an elongate bedway is provided with a handrail adjacent to each lateral side of the bedway. Each handrail has a longitudinally extending channel with an opening configured to receive the hand or fingers of a person using the slide or chute for protecting the hands and fingers of the user. The handrails may be formed integral with the slide or chute or may be provided as separate members for attachment to existing slides and chutes. Objects may also be passed through the longitudinal channels of the handrails from the top end to the bottom end of the slide or chute for amusement.

19 Claims, 4 Drawing Sheets

SLIDE WITH LATERAL SIDE CHANNELS

BACKGROUND OF THE INVENTION

1. Field of the Invention

This invention relates generally to slides and chutes, and more particularly to a slide or chute with handrails on lateral sides of the bedway which have a longitudinally extending channel to receive and protect the hand and fingers of a person using the slide or chute.

2. Brief Description of the Prior Art

Various slides and chutes are known in the art, such as playground slides, water slides, fire escape chutes, and emergency exit chutes for aircraft. The longitudinal bedway of slides and chutes may incorporate a variety of sliding path configurations, such as curved, spiral, or waves along the length of the bedway, and in some instances the slides and chutes may have a plurality of laterally adjacent bedways. Water slides and emergency escape chutes may be made of flexible material.

A typical playground slide has an inclined elongate longitudinal bedway, a longitudinal side wall at each lateral side of the bedway, and an outwardly rounded or tubular hand rail at the top of each side wall. In playground slides of metal construction, outwardly rounded or tubular hand rail is formed by rolling the top edge of the side wall over to form a cylindrical configuration. The tubular hand rails eliminate sharp metal edges and provide a rounded surface which may be gripped by the hands of the child using the slide.

More recently, playground slides and water slides of molded plastic construction have been developed. The molded slides also have an inclined elongate longitudinal bedway, a longitudinal side wall at each lateral side of the bedway. The molded slides usually have an outwardly rounded surface at the top of each side wall which serves as the hand rail.

Thus, most prior art slides and chutes have either a tubular hand rail at the top edge of the side walls or an outwardly rounded surface at the top of each side wall which serves as the hand rail. The child or person using the handrails of the slide or chute must therefore place their hands on the exterior of the handrail. Thus, the hands of the person using the slide are exposed to potential hazards.

For example, a child standing beside the bedway may grab the hand of a child sliding down the bedway or the child sliding down the bedway may grab some fixed object which could result in damage to the muscles or ligaments and/or injury to the fingers, hands, or arms.

Thornton, U.S. Pat. No. 1,680,753 discloses a slide having an inclined elongate longitudinal bedway, a longitudinal side wall at each lateral side of the bedway, an outwardly rounded surface at the top of each side wall and a tubular handrail disposed vertically above each side wall.

Lamar, U.S. Pat. No. 1,888,350 discloses an all metal slide having an inclined elongate longitudinal bedway, a longitudinal side wall at each lateral side of the bedway, and an outwardly rounded surface at the top of each side wall.

Ahrens, U.S. Pat. No. 4,811,943 discloses a molded slide having a elongate longitudinal spiral bedway, an integral longitudinal side wall at each lateral side of the bedway, and an outwardly rounded surface at the top of each side wall.

The present invention is distinguished over the prior art in general, and these patents in particular by a slide or chute having an elongate bedway provided with a handrail adjacent to each lateral side of the bedway. Each handrail has a longitudinally extending channel with an opening configured to receive the hand or fingers of a person using the slide or chute for protecting the hands and fingers of the user. The handrails may be formed integral with the slide or chute or may be provided as separate members for attachment to existing slides and chutes. Objects may also be passed through the longitudinal channels of the handrails from the top end to the bottom end of the slide or chute for amusement.

SUMMARY OF THE INVENTION

It is therefore an object of the present invention to provide a slide or chute having an elongate bedway and a handrail adjacent to each lateral side of the bedway which has a longitudinally extending channel with an opening configured to receive the hand or fingers of a person using the slide or chute for protecting the hands and fingers of the user.

It is another object of this invention to provide a handrail which can be easily and quickly attached to the lateral sides of the bedway of existing slide and chute devices which has a longitudinally extending channel with an opening configured to receive the hand or fingers of a person using the slide or chute for protecting the hands and fingers of the user.

Another object of this invention is to provide a slide or chute having an elongate bedway and a longitudinal channel adjacent to each lateral side of the bedway through which objects may be passed from the top end to the bottom end of the slide or chute.

Another object of this invention is to provide a longitudinal channel which can be easily and quickly attached to the lateral sides of the bedway of existing slide and chute devices through which objects may be passed from the top end to the bottom end of the slide or chute.

A further object of this invention is to provide a slide or chute having an elongate bedway and a handrail adjacent to each lateral side of the bedway for protecting the hands and fingers of the user which is simple in construction and economical to manufacture.

A still further object of this invention is to provide a handrail which can be attached to the lateral sides of the bedway of existing slide and chute devices for protecting the hands and fingers of the user which is simple in construction and economical to manufacture.

Other objects of the invention will become apparent from time to time throughout the specification and claims as hereinafter related.

The above noted objects and other objects of the invention are accomplished by a slide or chute having an elongate bedway provided with a handrail adjacent to each lateral side of the bedway. Each handrail has a longitudinally extending channel with an opening configured to receive the hand or fingers of a person using the slide or chute for protecting the hands and fingers of the user. The handrails may be formed integral with the slide or chute or may be provided as separate members for attachment to existing slides and chutes. Objects may also be passed through the longitudinal channels of the handrails from the top end to the bottom end of the slide or chute for amusement.

DESCRIPTION OF THE PREFERRED EMBODIMENT

Figure 1:
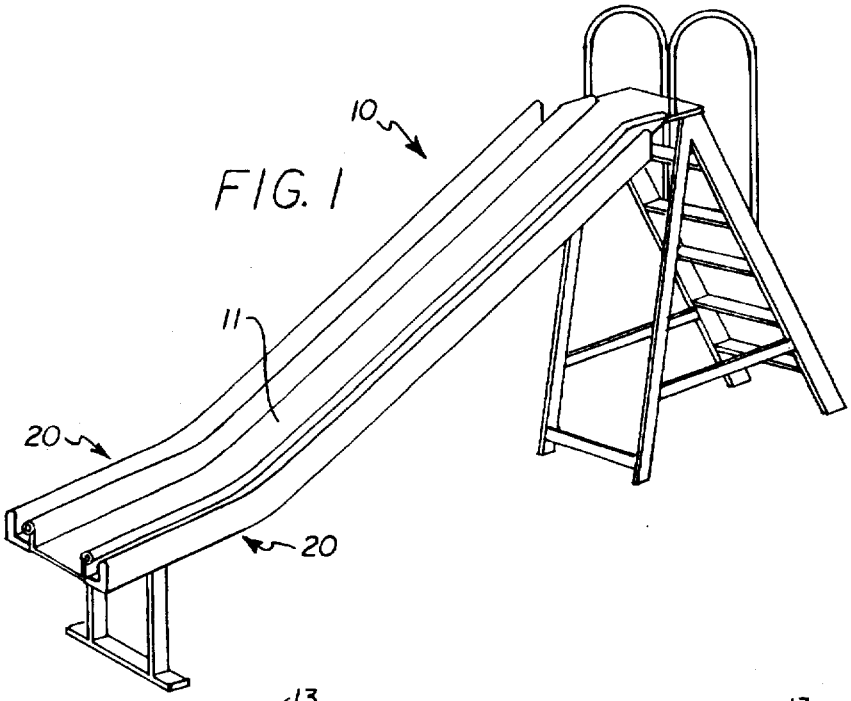
FIG. 1 is a perspective view of a slide device having a handrail in accordance with the present invention.

Referring to the drawings by numerals of reference, there is shown in FIG. 1, a playground slide 10 having an elongate bedway 11 provided with a handrail 20 adjacent to each lateral side of the bedway. The handrails 20 may be separate members adapted to be attached to existing slides and chutes or may be formed integral with the slide or chute as described hereinafter.

Figure 2:
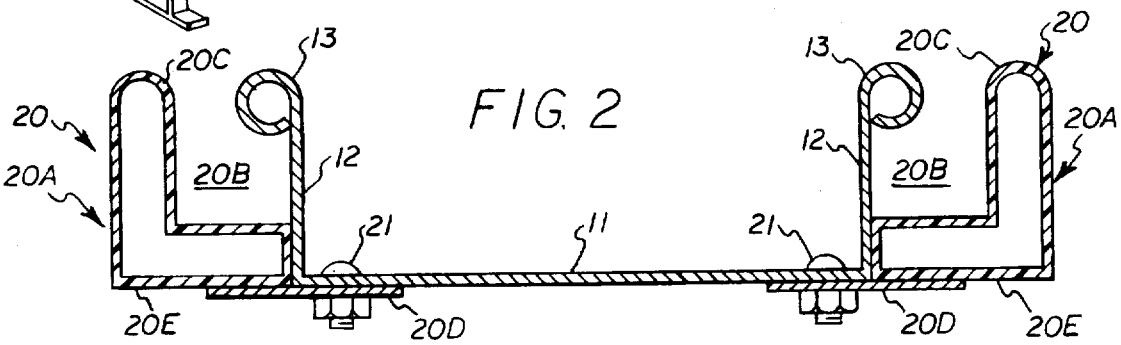
FIG. 2 is a transverse cross section through a portion of the bedway of a typical playground slide of metal construction provided with handrails in accordance with the present invention.

FIG. 2 shows, in transverse cross section, a portion of the inclined longitudinal bedway 11 of a typical playground slide of metal construction. Slides of this type have a longitudinal side wall 12 at each lateral side of the bedway 11, and an outwardly rounded or tubular surface 13 at the top of each side wall which is formed by rolling the top edge of the side wall over to form a cylindrical configuration. Although the rounded surface of 13 of the side walls 12 eliminate sharp edges and serve as a handrail, the child or person using the handrails of prior art slides must place their hands and fingers on the exterior of the handrail or the outer side walls, thus exposing the hands and fingers of the user to potential hazards.

In accordance with the present invention, an elongate longitudinal handrail 20 is secured adjacent to each lateral side of the bedway 11. The handrails 20 are preferably formed of a semi-rigid weather resistant plastic material. It should be understood that the handrails 20 may also be formed of meta, fiberglass, rubber, or other suitable materials, and may also be flexible or inflatable.

In the example of FIG. 2, each handrail 20 is generally L-shaped in cross section 20A and is secured to the bedway 11 of the slide such that it is disposed along the outer longitudinal side of each side wall 12 to define a U-shaped channel 20B between each side wall and the upstanding leg 20C of each L-shaped handrail. The longitudinally extending channel 20B provides an opening which receives the hand or fingers of the person using the slide and the upstanding leg 20C provides an outer wall which protects the hands and fingers of the user.

Figure 3:
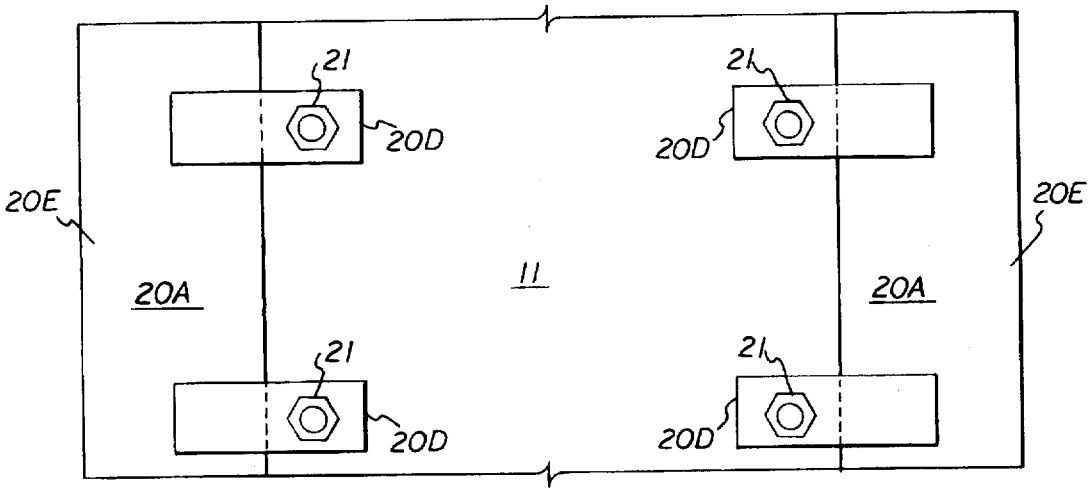
FIG. 3 is a bottom plan view showing a handrail secured to the underside of the bedway of the slide.

Referring additionally to FIG. 3, the L-shaped handrail 20A has a series of longitudinally spaced tabs 20D along its length which extend laterally outward from its bottom surface 20E and are used to attach the handrail to the slide. The handrails may be secured to the slide by any conventional fastening means, such as welding, epoxy, screw type fasteners, or bolting, depending upon the materials used for the handrails. In the illustrated example, the tabs 20D of the handrails 20A are epoxied to the bottom surface 20E of the handrail and secured to the bedway 11 of the slide by bolts and nuts 21.

Figure 4:
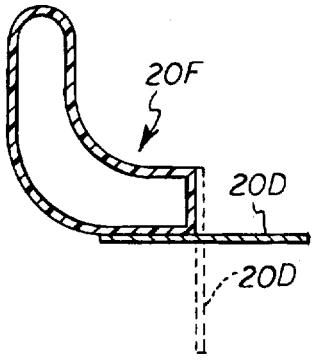
FIG. 4 is a cross section of a handrail which has a rounded generally arcuate cross section
Figure 5:
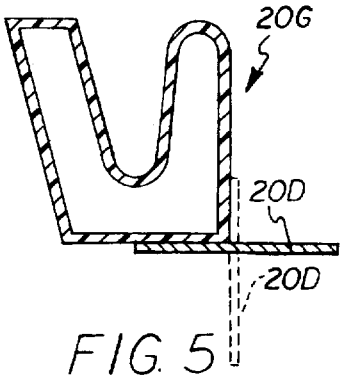
FIG. 5 is a cross section of a handrail which has a generally V-shaped cross section.
Figure 6:
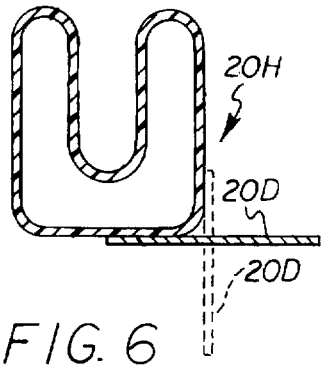
FIG. 6 is a cross section of a handrail which has a generally U-shaped cross section.

The handrails may be provided with various cross sectional configurations. FIG. 4 shows an embodiment of the L-shaped handrail 20F which has a rounded generally arcuate cross section and is secured to the bedway 11 as described above. FIG. 5 shows an embodiment of the handrail 20G which has a generally V-shaped cross section. FIG. 6 shows an embodiment of the handrail 20H which is generally U-shaped in cross section. As shown in dashed line, the handrails may be provided with vertically disposed tabs 20D for securing them to the upstanding side wall 12 of the slide with conventional fastening means, rather than to the bedway.

Figure 7:
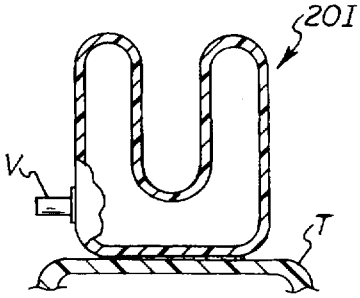
FIG. 7 is a cross section of an inflatable handrail which has a generally U-shaped cross section.

FIG. 7 shows an inflatable handrail 20I which is generally U-shaped in cross section and which is attached to the top surface T of an existing slide adjacent to the existing bedway by epoxy, glue or other suitable fastening means. The inflatable handrail 20I has an inflation valve V for filling the handrail with a fluid.

Although the slide depicted in FIG. 1 shows an elongate longitudinal inclined bedway, it should be understood that the slide may also have an elongate spiral bedway.

Figure 8:
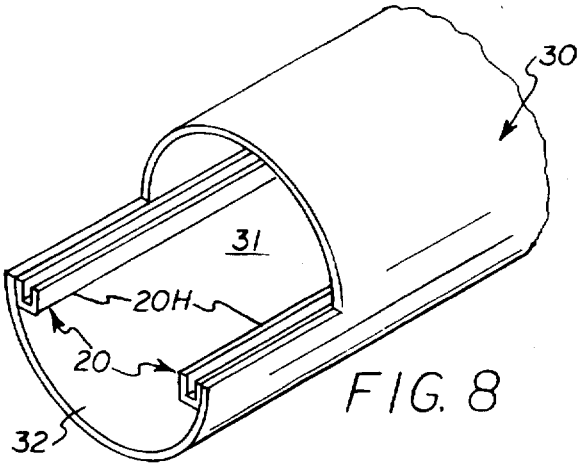
FIG. 8 is a perspective view showing a portion of a tunnel-type slide of hollow generally cylindrical configuration with handrails installed on the interior surface in laterally opposed relation.

FIG. 8 shows a tunnel-type slide 30 which is a hollow generally cylindrical configuration and the interior thereof 31 serves as the elongate bedway 32. For this type of slide, the handrails 20 are installed on the interior surface 31 in laterally opposed relation. In the example of FIG. 8, each handrail 20 is generally U-shaped in cross section 20H and is secured to the interior surface 31 of the slide by conventional fastening means such as epoxy, welding, screw type fasteners, or bolting, depending upon the materials of the slide and handrails. The handrails 20 may also be of other cross sectional configurations, such as an L-shaped, arcuate, or V-shaped cross section, as discussed above. The handrails may also be provided with a series of longitudinally spaced tabs along its length which extend vertically outward for securing the handrails to the interior surface of the slide, as shown in dashed line in FIGS. 4–6.

Figure 9:
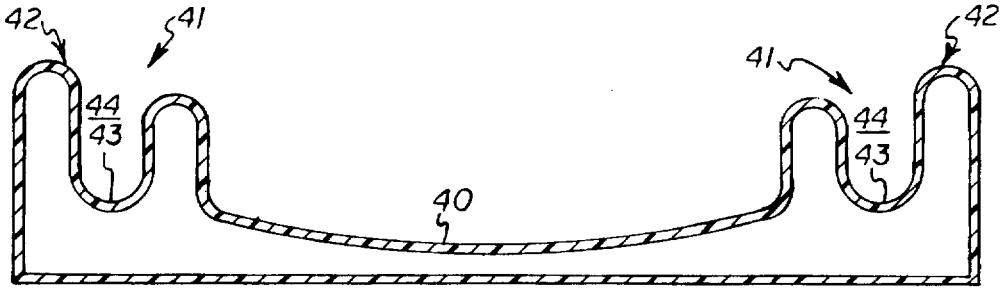
FIG. 9 is a transverse cross section through a portion of the bedway of a slide having integrally formed handrails.

The handrails may also be formed integrally with the slide. FIG. 9 shows, in transverse cross section, a portion of the inclined longitudinal bedway 40 of a playground slide having integrally formed handrails 41. The slide has an upstanding longitudinal side wall 42 at each lateral side of the bedway 40, and a U-shaped inwardly rounded surface 43 along the top of each side wall which defines a longitudinally extending U-shaped channel 44 at the top of the each side wall. The longitudinally extending channel 44 provides an opening which receives the hand or fingers of the person using the slide and protects the hands and fingers of the user.

Figure 10:
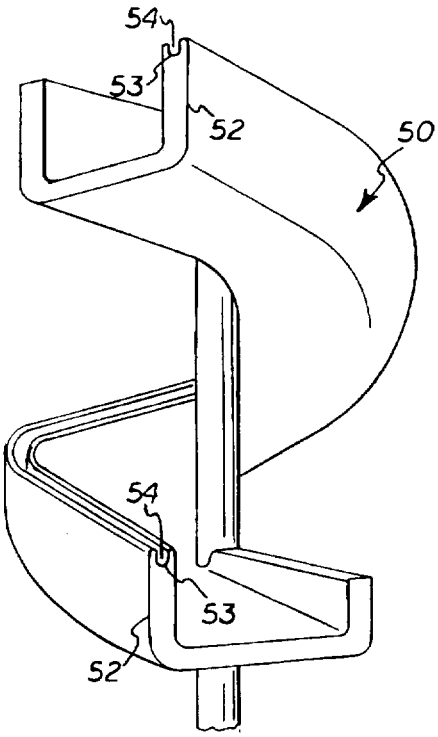
FIG. 10 is a perspective view of a slide with an elongate spiral bedway having an integrally formed handrail on the outer side wall of the bedway.

FIG. 10 shows a slide 50 having an elongate spiral bedway 51 with an upstanding longitudinal side wall 52 at the outer side of the bedway, and a U-shaped inwardly rounded surface 53 along the top of the outer side wall which defines a longitudinally extending U-shaped channel 54 at the top of the outer side wall.

Figure 11:
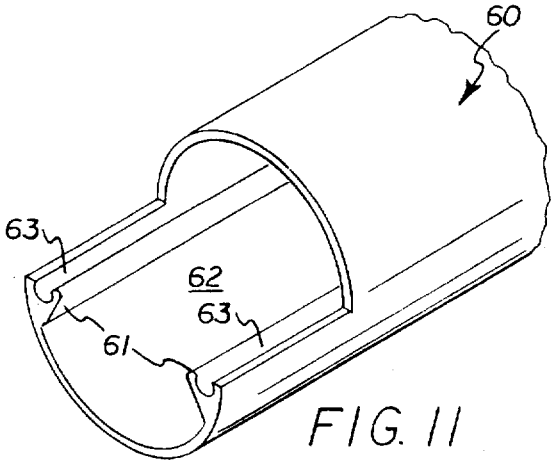
FIG. 11 is a perspective view of a tunnel-type slide having a pair of integrally formed handrails on its interior surface.

FIG. 11 shows a tunnel-type slide 60 having a hollow generally cylindrical configuration and a pair of U-shaped handrails 61 integrally formed on its interior surface 62 in laterally opposed relation. The handrails 61 provide longitudinally extending U-shaped channels 63 at the laterally opposed sides of the interior of the slide.

Figure 12:
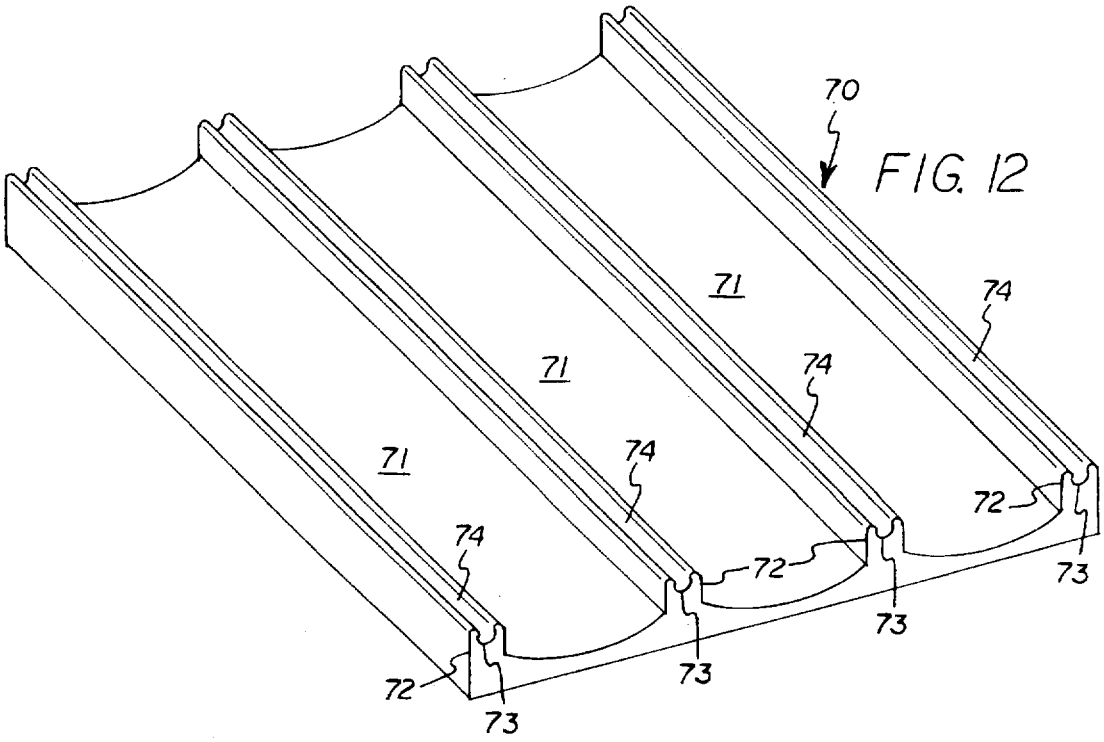
FIG. 12 is a perspective view of a portion of a slide having adjacent elongate bedways with handrails integrally formed in each side wall of each bedway.

FIG. 12 shows a slide 70 having adjacent elongate bedways 71 with an upstanding longitudinal side wall 72 at each side of each bedway, and a U-shaped inwardly rounded surface 73 along the top of each side wall which defines a longitudinally extending U-shaped channel 74 at the lateral sides of the bedways.

Figure 13:
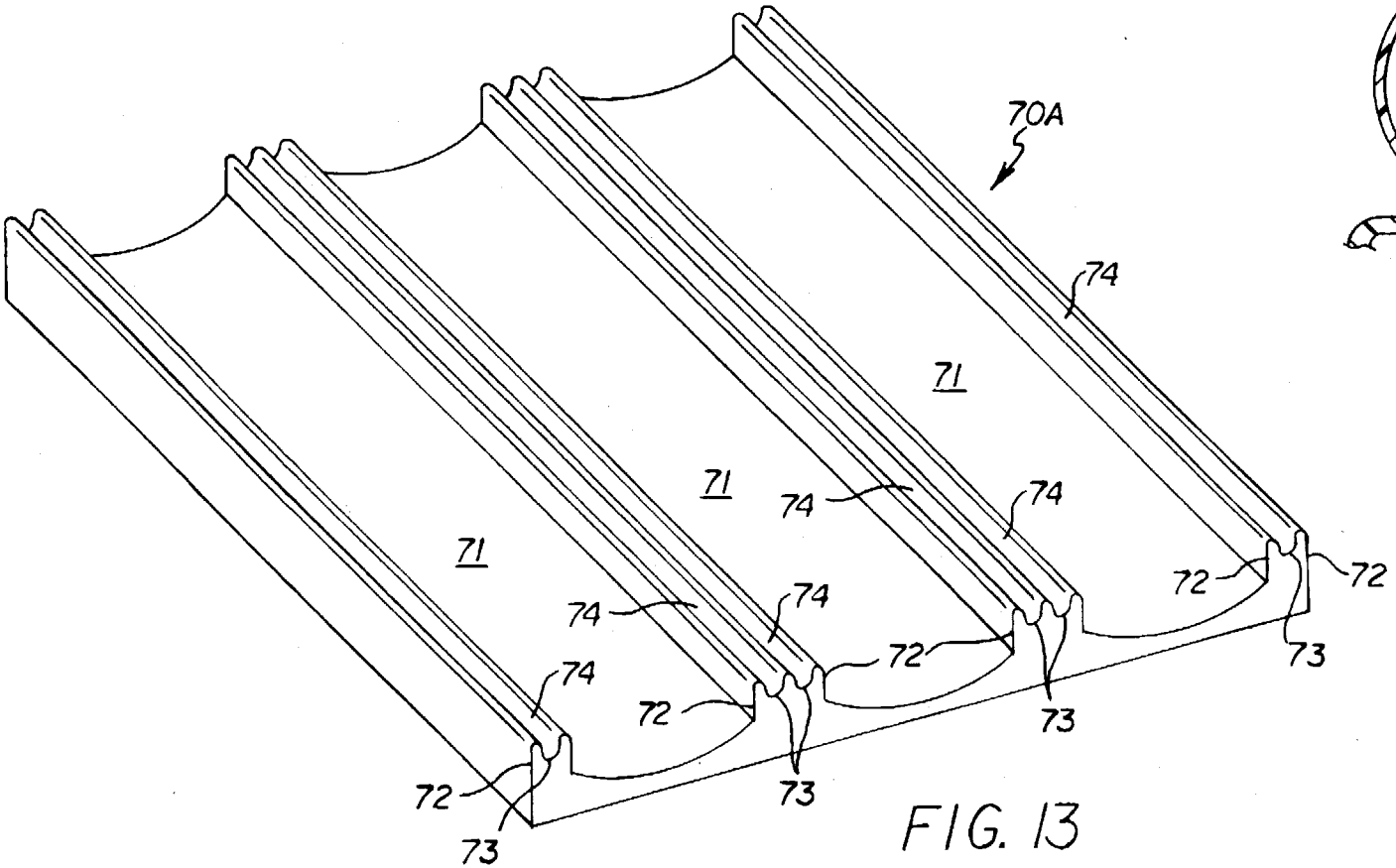
FIG. 13 is a perspective view of a portion of a slide having adjacent elongate bedways with a handrail integrally formed in the outer side wall of the outer bedways and a pair of handrails between the adjacent bedways.

FIG. 13 shows a slide 70 having adjacent elongate bedways 71 with an upstanding longitudinal side wall 72 at each side of each bedway, and a U-shaped inwardly rounded surface 73 along the top of each side wall which defines a longitudinally extending U-shaped channel 74 at the lateral sides of the bedways. In this embodiment there is a channel 74 integrally formed in the outer side wall of the outer bedways and a pair of channels between the adjacent bedways.

While the handrails described above provide a channel which protects the hands and fingers of a person using the slide, the handrails also provide an elongate longitudinal channel through which objects may be passed from the top end to the bottom end of the slide or chute for amusement. For example, balls may be rolled down the channels or water may be poured or discharged from a hose to run down the channels.

Figure 14:
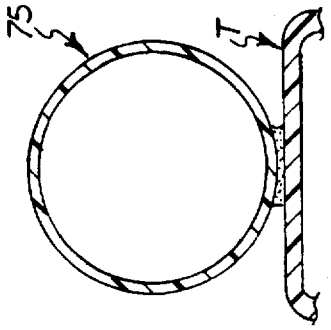
FIG. 14 is a transverse cross section through a handrail which has a circular cross section.

FIG. 14 shows an elongate tubular handrail 75 which is circular in transverse cross section, and which is attached to the top surface T of an existing slide adjacent to the existing bedway by epoxy, glue or other suitable fastening means. The circular cross section hand rail 75 provides an elongate longitudinal channel through which objects may be passed, or water may be run, from the top end to the bottom end of the slide or chute for amusement. It should be understood that the circular cross section handrail may also be made of flexible material and provided with an inflation valve for filling the handrail with a fluid.

It should be understood that the handrails in accordance with the present invention may provided on water slides, fire escape chutes, and emergency exit chutes for aircraft, as well as playground slides, and on slides and chutes formed of flexible material.

While this invention has been described fully and completely with special emphasis upon several preferred embodiments, it should be understood that within the scope of the appended claims the invention may be practiced otherwise than as specifically described herein.

I claim:

1. A slide device comprising:

an elongate bedway;

a handrail adjacent to each lateral side of said bedway;

means for securing said handrails adjacent to each side of said bedway; and each said handrail having a longitudinally extending channel with an upwardly facing opening configured to receive and partially surround the hand or fingers of a person using the slide device to protect the hands and fingers of the user.

2. A slide device according to claim 1 wherein said channel is generally U-shaped in cross section.

3. A slide device according to claim 1 wherein said channel is generally V-shaped in cross section.

4. A slide device according to claim 1 wherein said elongate bedway has an upstanding longitudinal side wall at each lateral side thereof with an outwardly rounded top surface, and each said handrail is generally L-shaped in cross section and disposed on the outer longitudinal side of each said side wall to define a generally U-shaped channel between each said side wall and the upstanding leg of each said L-shaped handrail.

5. A slide device according to claim 1 wherein said elongate bedway has an upstanding longitudinal side wall at each lateral side thereof with an outwardly rounded top surface, and each said handrail is generally U-shaped in cross section and disposed on the outer longitudinal side of each said side wall.

6. A slide device according to claim 1 wherein said elongate bedway has an upstanding longitudinal side wall at each lateral side thereof with an outwardly rounded top surface, and each said handrail is generally V-shaped in cross section and disposed on the outer longitudinal side of each said side wall.

7. A slide device according to claim 1 wherein said slide device is a hollow generally cylindrical configuration and the interior thereof defining said elongate bedway; and each said handrail is generally L-shaped in cross section and a pair of said handrails are disposed on the interior surface in laterally opposed relation to define a generally U-shaped channel between said interior surface and the upstanding leg of each said L-shaped handrail.

8. A slide device according to claim 1 wherein said slide device is a hollow generally cylindrical configuration and the interior thereof defining said elongate bedway; and each said handrail is generally U-shaped in cross section and a pair of said handrails are disposed on the interior surface in laterally opposed relation to define a U-shaped channel on laterally opposed sides of said interior surface.

9. A slide device according to claim 1 wherein said slide device is a hollow generally cylindrical configuration and the interior thereof defining said elongate bedway; and each said handrail is generally V-shaped in cross section and a pair of said handrails are disposed on the interior surface in laterally opposed relation to define a generally V-shaped channel on laterally opposed sides of said interior surface.

10. A slide device according to claim 1 wherein:

said slide device has laterally adjacent elongate bedways; and at least one said handrail adjacent to each lateral side of each of said bedways.

11. A handrail for attachment to an existing slide device having a longitudinal bedway, the handrail comprising:

an elongate handrail having a longitudinally extending channel with an upwardly facing opening configured to receive and partially surround the hand or fingers of a person using the slide device to protect the hand and fingers of the user, and means for securing said handrail adjacent to the longitudinal bedway of the existing slide device.

12. A handrail according to claim 11 wherein said channel is generally U-shaped in cross section.

13. A handrail according to claim 11 wherein said channel is generally V-shaped in cross section.

14. A handrail according to claim 11 wherein said handrail is adapted to be secured to an existing slice device having an elongate bedway having an upstanding longitudinal side wall at each lateral side thereof with an outwardly rounded top surface, and said handrail is generally L-shaped in cross section and adapted to be secured along the outer longitudinal side of each said side wall to define a generally U-shaped channel between each said side wall and the upstanding leg of each said L-shaped handrail.

15. A handrail according to claim 11 wherein said handrail is adapted to be secured to an existing slide device having a hollow generally cylindrical configuration and an interior surface defining the longitudinal bedway; and said handrail is generally L-shaped in cross section and adapted to be secured in pairs on said interior surface in laterally opposed relation to define a generally U-shaped channel between said interior surface and the upstanding leg of each said L-shaped handrail.

16. A handrail according to claim 11 wherein said handrail is adapted to be secured to an existing slice device having a hollow generally cylindrical configuration and an interior surface defining the longitudinal bedway; and said handrail is generally U-shaped in cross section and adapted to be secured in pairs on said interior surface in laterally opposed relation to define a generally U-shaped channel on laterally opposed sides of said interior surface.

17. A handrail according to claim 11 wherein said handrail is adapted to be secured to an existing slide device having a hollow generally cylindrical configuration and an interior surface defining the longitudinal bedway; and said handrail is generally V-shaped in cross section and adapted to be secured in pairs on said interior surface in laterally opposed relation to define a generally V-shaped channel on laterally opposed sides of said interior surface.

18. A handrail according to claim 11 wherein:

said handrail is adapted to be secured to an existing slide device having laterally adjacent longitudinal bedways; and said handrail is adapted to be secured at each lateral side of each of said bedways.

19. A handrail according to claim 11 wherein:

said handrail is an elongate inflatable member having inflation means for filling it with a fluid and having a longitudinally extending channel with an upwardly facing opening configured to receive and partially surround the hand or fingers of a person using the slide device for protecting the hand and fingers of the user.

* * * * *